United States Patent [19]

Kuna et al.

[11] 4,245,842

[45] Jan. 20, 1981

[54] PROJECTILE LAUNCHING GAME

[75] Inventors: Wayne A. Kuna, Elmhurst; Jeffrey D. Breslow, Highland Park, both of Ill.

[73] Assignee: Marvin Glass & Associates, Chicago, Ill.

[21] Appl. No.: 958,181

[22] Filed: Nov. 6, 1978

[51] Int. Cl.[3] ..... A63F 9/02

[52] U.S. Cl. ..... 273/357; 273/393; 273/399; 273/129 P; 124/17

[58] Field of Search ..... 273/101, 105 R, 129 D, 273/127 R, 335, 356, 357, 399, 129 P, 393; 124/10, 16, 17

[56] References Cited

U.S. PATENT DOCUMENTS

| | | | |
|---|---|---|---|
| 477,287 | 6/1892 | Zimmerling | 273/105 R |
| 1,268,115 | 6/1918 | Haines et al. | 273/101 |
| 1,942,476 | 1/1934 | Harris | 273/101 |
| 2,101,658 | 12/1937 | Szabo | 273/101 |
| 2,872,194 | 2/1959 | Kellinger | 273/127 R |
| 3,637,213 | 1/1972 | Breslow et al. | 273/101 |
| 3,685,829 | 8/1972 | Barlow | 273/101 |
| 4,111,179 | 9/1978 | Hashimoto | 124/17 X |
| 4,174,835 | 11/1979 | Breslow et al. | 273/357 |

FOREIGN PATENT DOCUMENTS

| | | | |
|---|---|---|---|
| 177962 | 9/1935 | Switzerland | 273/105 R |
| 18853 | of 1906 | United Kingdom | 273/101 |

*Primary Examiner*—Anton O. Oechsle
*Attorney, Agent, or Firm*—Mason, Kolehmainen, Rathburn & Wyss

[57] ABSTRACT

A skill-type game is disclosed having two opposing projectile launching areas, each launching area including means for launching a projectile and a projectile receiving target area including at least one projectile-receiving upstanding channel adapted to receive a plurality of projectiles, one at a time, in stacked relation one above another. Each launching area includes means for launching a projectile upwardly from a game floor area into a channel, and means for launching a projectile along the game floor area to dislodge a lowermost projectile out of a channel.

14 Claims, 6 Drawing Figures

PROJECTILE LAUNCHING GAME

FIELD OF THE INVENTION

The present invention relates to a skill-type game and, more particularly, to a competitive game requiring the skill and judgment of each player in launching projectiles into designated target areas.

BACKGROUND OF THE INVENTION

A number of games are presently available having, as at least one object, the launching of projectiles into designated target areas. One such game is disclosed in U.S. Pat. No. 3,685,829. In this patent, a game is disclosed wherein projectiles are propelled through a restricted path toward a "home" position for each player. In order to win the game, each player has to propel his entire allotment of projectiles through the restriction before his opponent. In this prior art game, once a projectile proceeds to the home position, by passing through a central target aperture, the ball or projectile is automatically returned to the player's opponent and requires no further skill in removing the projectile from the home position. In accordance with the present invention, a plurality of projectile holding areas or channels are provided for removably retaining the projectiles in a home position in stacked relationship, one above another. The lowermost projectile in each home position channel can be knocked out of the channel by any player by striking the lowermost projectile with another projectile and thereby removing an opponent's projectile from the home position.

SUMMARY OF THE INVENTION

An object of the present invention is to provide a skill-type game including at least two spaced launching devices selectively operable by individual players of the game for propelling objects into a desired home position.

Another object of the present invention is to provide a skill-type game having at least two spaced launching devices for propelling an object into one of a plurality of spaced projectile stacking means or channels so that each player can attempt to stack a plurality of his differentiable projectiles into a single channel in consecutive, stacked relationship.

Another object of the present invention is to provide a skill-type game including at least two spaced launching devices selectively operable by individual players of the game where each player has projectiles which are differentiable by sight from his opponent's projectiles and wherein the game includes a plurality of spaced channels, slightly wider than the projectiles, which define projectile home positions common to both opponents.

Another object of the present invention is to provide a skill-type game including at least two spaced launching devices and a plurality of substantially vertical channels disposed therebetween, said channels adapted to maintain a plurality of projectiles in stacked, substantially vertical alignment, one above another, wherein the lowermost projectile in each channel is held in a recess and capable of being knocked away from the channel when struck by another projectile.

In brief, the skill-type game of the present invention includes a pair of projectile launching stations and a projectile target area, disposed centrally between the launching stations, having a plurality of projectile receiving channels each adapted to receive a plurality of projectiles in stacked relation one above another. The channels are constructed such that a lowermost projectile contained in each channel is substantially unrestricted in movement so that the lowermost projectile of each channel can be knocked out of the channel when struck by another projectile. The launching stations can be operated in two modes in launching a projectile either upwardly into a channel, or along a floor member to strike a lowermost projectile and thereby knock the projectile out of the channel. In a preferred embodiment, an object of the game may be for each player to secure a designated number of his projectiles in a channel in consecutive stacked relation one above another with an opponent attempting to prevent consecutive alignment by interspersing his own projectiles between his opponents' and by knocking his opponents' projectiles out of the channels.

These and other objects and advantages of the present invention will become apparent from the following detailed description of the present invention.

DETAILED DESCRIPTION OF THE INVENTION

Figure 1:
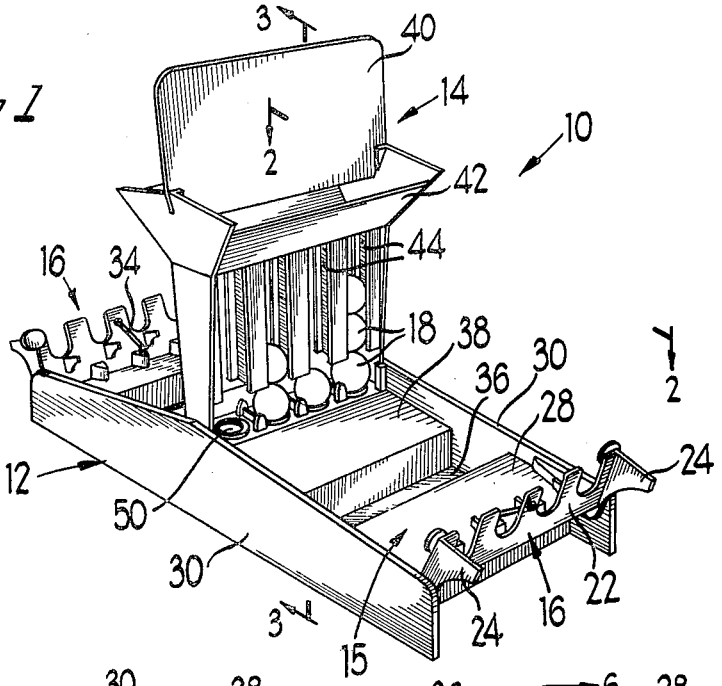
FIG. 1 is a perspective view of a skill-type game constructed in accordance with the principles of the present invention.

Turning now to the drawings, and initially to FIG. 1, there is illustrated a preferred embodiment of the skill-type game of the present invention, generally designated by reference numeral 10. The game includes a base portion, generally designated by reference numeral 12, an upstanding target area, generally designated by reference numeral 14, and a pair of launching devices, generally designated by reference numeral 16, disposed at opposite ends of the base 12. The launching devices 16 are selectively operable by individual players of the game for launching one or more projectiles 18, preferably spherical in shape.

Figure 6:
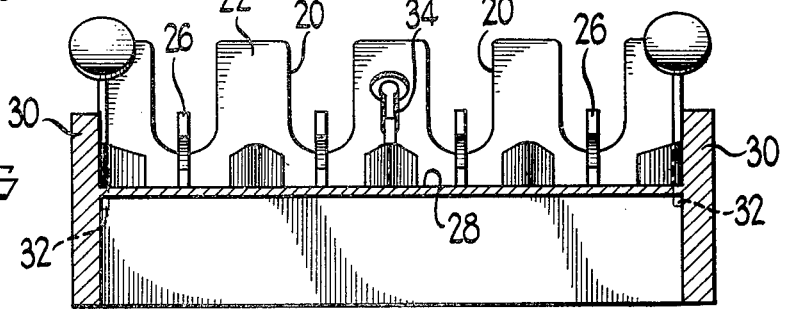
FIG. 6 is a partially elevated end view of the skill-type game of the present invention taken along the lines 6—6 of FIG. 2.
Figure 5:
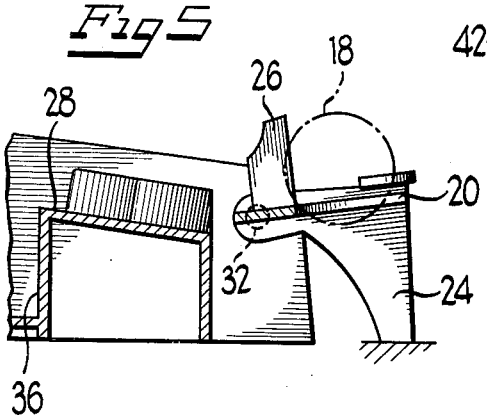
FIG. 5 is an enlarged, partially broken-away partially elevated side view of a ball launching means constructed in accordance with the principles of the present invention.
Figure 3:
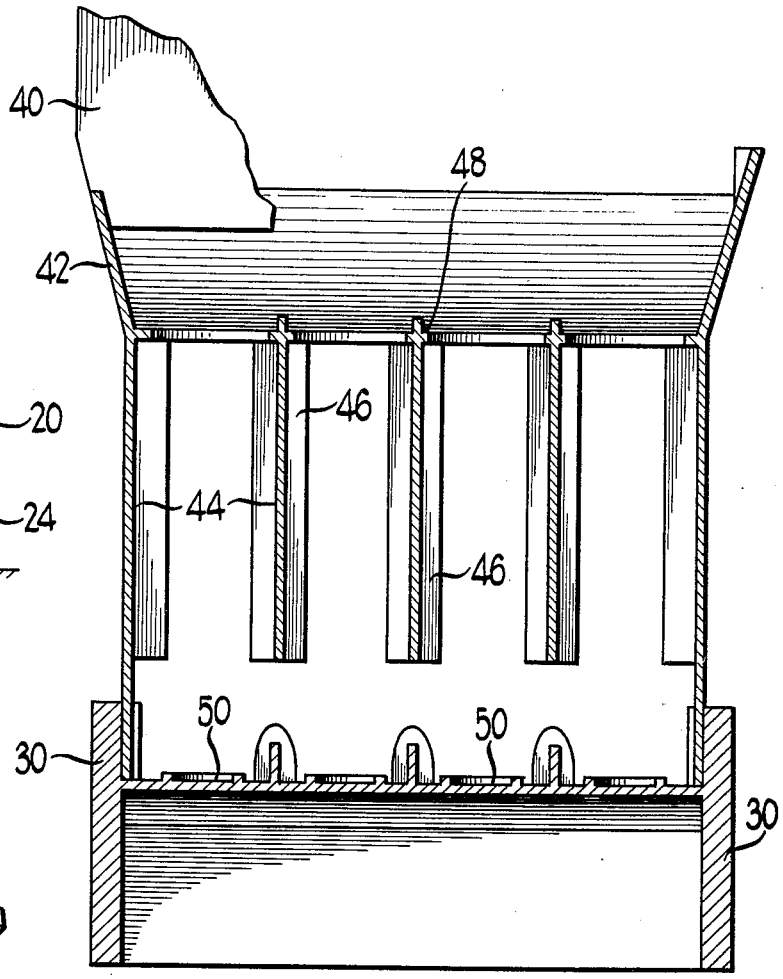
FIG. 3 is an enlarged partially elevated, partially broken-away side view of the skill-type game of the present invention taken along the line 3—3 of FIG. 1.
Figure 4:
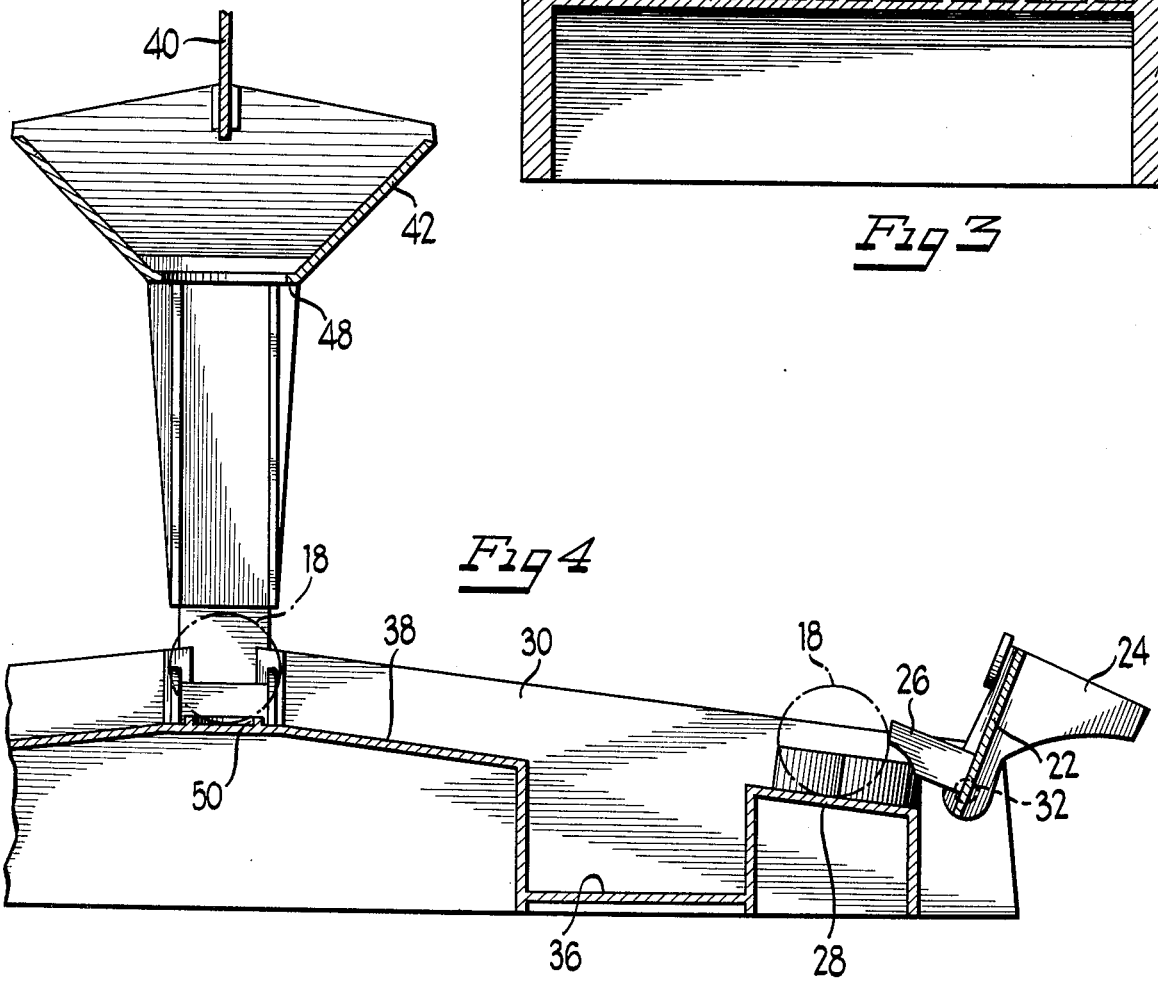
FIG. 4 is a partially elevated, partially broken-away side view of the skill-type game of the present invention taken along the line 4—4 of FIG. 2.

Each launching device 16 includes a plurality of spaced projectile receiving positions 20 for initially positioning a projectile prior to launching (FIG. 6). In accordance with a preferred embodiment of the present invention, each launching station 16 includes a single lever arm 22 including a plurality of projectile receiving launching positions 20. In accordance with an important feature of the present invention, each launching station 16 has two modes of operation as shown in FIGS. 4 and 5. In accordance with one mode of operation, as best shown in FIG. 5, one or more projectiles 18 are disposed on the projectile receiving launching positions 20 and the lever arm 22 is forced by hand downwardly until its lever arm legs or stop means 24 reach the ground level or table top level (FIG. 5). When the lever arm 22 is released from this position, the projectile 18 is launched upwardly toward the upstanding target area 14.

Figure 2:
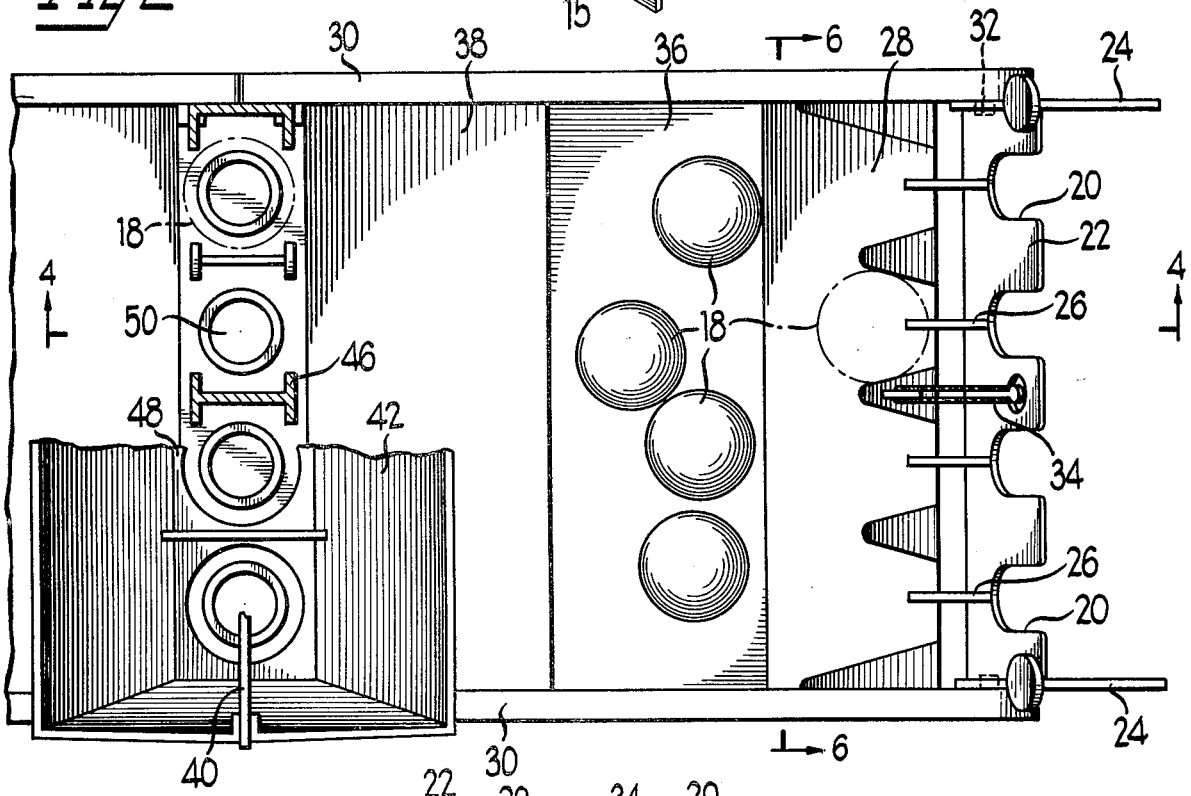
FIG. 2 is an enlarged, partially elevated, partially broken-away top view of the skill-type game of the present invention taken along the lines 2—2 of FIG. 1.

In the second mode of operation, as shown in FIG. 4, the projectiles are shot along a floor 15 of base 12 toward one of the lowermost positioned projectiles disposed in a target area channel in an attempt to dislodge an opponent's projectile from the target area. The launching station lever arm 22 includes a plurality of projectile pinching arms 26 (FIG. 4) so that a projectile 18 can be pinched against a substantially flat base portion 28 disposed beneath the lever arm 22 by rotating the lever arm 22 upwardly toward the projectile target area 14 until the projectile pinching arm 26 contacts the projectile 18 as shown in FIG. 2. Further rotation of the lever arm 22 against the projectile 18 will cause the projectile 18 to slide away from the pinching arm 26 as shown in FIG. 4 and propel the projectile 18 slidingly along the base portion 28 over a ball receiving station 36 and cause the projectile 18 to strike a lowermost projectile in one of the projectile receiving channels with which the propelled ball is aligned.

The lever arm 22 is pivotably mounted to sidewall 30 of base number 12 by connecting lever arm legs 24 to the sidewalls 30 through shafts 32. The lever arm 22 is spring biased toward base portion 28 of base member 12 by attaching the lever arm 22 thereto with a rubber band 34 or similar tensioning means to provide sufficient force to propel the projectile 18 upwardly into the target area 14 when the lever arm 22 is released from its position shown in FIG. 5.

The base portion 12 of the skill-type game of the present invention generally comprises two side walls 30, and on each side of the projectile target area, a projectile receiving trough 36 and a projectile receiving and directing floor member comprising base portions 28 and 38 disposed transversely between wall members 30.

Projectile target area 14 is disposed transversely and centrally above base member 12 and generally includes a projectile rebound shield or backboard 40, a projectile receiving trough 42 disposed directly under the backboard 40, and a plurality of projectile receiving channels or slots 44 for receiving the projectiles 18 launched into trough 42. The channels 44 are disposed substantially equi-distant between the two launching stations 16 and are aligned in a plane substantially perpendicular to a plane passing through either base member sidewall 30. Channels 44 form common target areas for projectiles launched from either launching station 16 so that each opponent can attempt to launch projectiles 18 into the same channels 44. The channels 44 are formed from substantially perpendicularly aligned, substantially vertical I-shaped projectile holding members 46 and extend from a base portion 48 of trough 42 to a distance slightly greater than one projectile diameter above the floor of the base 12. In this manner, each projectile 18 in a lowermost position in each channel 44 can be knocked free from the channel 44 of the projectile receiving target area 14 when struck with another projectile 18. At the lowermost floor or bottom portion of each channel 44 is disposed a projectile receiving recess 50 for retaining a lowermost projectile in position at the lowermost point of each channel 44. When such lowermost projectile of each channel is struck by another projectile, it will be dislodged from this recess 50 and propelled into one of the projectile receiving troughs 36. The projectile receiving troughs 36 are of sufficient depth that a projectile received therein will not extend above the base floor members 28 and 38 so that the launching of a projectile 18 along floor members 28 and 38 toward a lowermost projectile in a channel 44 will not cause a projectile collision of a launched projectile with a projectile contained within trough 36.

We claim:

1. A skill-type game, comprising:

a game board;

a target area disposed transversely across the center of said game board;

two opposing launching areas, one at each end of the game board, each launching area including means for manually launching an aerial projectile along a path through the air toward the target area, said projectile launching means including a launcher pivotally connected to the end of said game board and biasing means for urging said launcher toward the target area; and a projectile receiver at the target area, including a plurality of generally vertical projectile receiving channels, each adapted to receive a plurality of projectiles in a stacked relation therein and formed from a plurality of substantially parallel I-shaped support members spaced a distance greater than a diameter of said projectiles.

2. A skill-type game, comprising:

a game board;

a target area disposed transversely across the center of said game board;

two opposing launching areas, one at each end of the game board, each launching area including means for manually launching an aerial projectile along a path through the air toward the target area, said projectile launching means including a launcher pivotally connected to the end of said game board and biasing means for urging said launcher toward the target area;

a projectile receiver at the target area, including a plurality of generally vertical projectile receiving channels, each adapted to receive a plurality of projectiles in a stacked relation therein; and a floor means, a portion of said floor means being disposed directly under said channels, said floor means portion including a projectile receiving recess means disposed under each channel for retaining a projectile in a lowermost position along a longitudinal axis of each channel.

3. The game of claim 2 wherein said channels include sidewall means for retaining a plurality of projectiles launched into a channel in stacked relation, one above another.

4. The game of claim 3 wherein said wall means is disposed between adjacent channels and disposed at a distance above said floor means such that said wall means retain all except the lowermost stacked projectiles in stacked relation, but said lowermost projectile is free to be dislodged out of its projectile receiving recess when struck by another projectile.

5. The game of claim 2 wherein said floor means includes a projectile guide surface disposed in a plane passing through a lowermost projectile positioned in each channel so that projectiles launched along said guide surface can strike one or more of said lowermost projectiles.

6. The game of claim 2 wherein said floor means includes a projectile receiving trough.

7. A skill-type game, comprising:

a game board;

a target area disposed transversely across the center of said game board;

two opposing launching areas, one at each end of the game board, each launching area including means for manually launching an aerial projectile along a path through the air toward the target area, said projectile launching means including a launcher pivotally connected to the end of said game board and biasing means for urging said launcher toward the target area; and a projectile receiver at the target area, including a plurality of generally vertical projectile receiving channels, each adapted to receiver a plurality of projectiles in a stacked relation therein, each of said means for launching a projectile including means for launching a projectile upwardly from a game floor area into a channel, and means for launching a projectile along said game floor area toward a projectile received in said target area.

8. The game of claim 7 wherein said means for launching a projectile along said game floor area comprises means for striking a projectile to cause said projectile to be projected away from said launcher along said game floor.

9. A skill-type game, comprising:

a game board;

a target area disposed transversely across the center of said game board;

two opposing launching areas, one at each end of the game board, each launching area including means for manually launching an aerial projectile along a path through the air toward the target area, said projectile launching means including a launcher pivotally connected to the end of said game board including a pivotally mounted planar member having a plurality of projectile receiving positions thereon for launching projectiles toward different positions on the target area and biasing means for urging said launcher toward the target area; and a projectile receiver at the target area, including a plurality of generally vertical projectile receiving channels, each adapted to receive a plurality of projectiles in a stacked relation therein.

10. A competitive game, comprising:

a game board having two opposing player stations, one at each end of the game board;

a projectile receiving target in the center of the board, said target having a plurality of upstanding projectile receiving channels, each adapted to receive a plurality of projectiles in a stacked relation therein, each of said channels terminating in a spaced relation relative to the game board so that the lowermost projectile is free to be dislodged therefrom upon impact by another projectile; and a manually operable launching device at each of said player stations, said launching device comprising a pivotally mounted launcher at each end of the game board, said launcher including a plurality of projectile receiving positions thereon for receiving and launching projectiles through an aerial path toward the projectile receiving target and means for engaging a projectile on the game board adjacent the launcher for directing a projectile toward one of the lowermost projectiles in one of the projectile receiving channels.

11. The competitive game of claim 10 including one projectile receiving recess means disposed under each channel for retaining a projectile in a lowermost position generally along the vertical axis of the channel.

12. The competitive game of claim 11 wherein said game board includes a projectile guide surface disposed in a plane passing through the lowermost projectile positioned in each channel on the projectile receiving recess so that projectiles launched along said guide surface strike one of the lowermost projectiles.

13. The competitive game of claim 12 including projectile launching positioning means adjacent the projectile launchers for supporting and retaining projectiles in a position to be launched toward the lowermost projectiles in the projectile receiving channels.

14. The competitive game of claim 13 wherein said secondary projectile receiving means includes a plurality of generally raised triangular surfaces for aligning projectiles prior to launching.

* * * * *